United States Patent [19]

Bean

[11] Patent Number: 4,528,782

[45] Date of Patent: Jul. 16, 1985

[54] SANDBLAST NOZZLE

[75] Inventor: George Bean, Windsor, Ohio

[73] Assignee: The Johnson Rubber Company, Middlefield, Ohio

[21] Appl. No.: 430,805

[22] Filed: Sep. 30, 1982

[51] Int. Cl.[3] ..... B24C 5/04

[52] U.S. Cl. ..... 51/439; 239/598; 239/591

[58] Field of Search ..... 51/439, 427, 411; 239/591, 598, 600; 291/46

[56] References Cited

U.S. PATENT DOCUMENTS

| | | | |
|---|---|---|---|
| 1,170,198 | 2/1916 | Sweet et al. | 51/439 |
| 1,292,371 | 1/1919 | Reilly | 239/600 |
| 2,606,073 | 8/1952 | Uhri | 51/439 |
| 3,178,120 | 4/1965 | Kappel | 239/600 |
| 3,228,147 | 1/1966 | Moore | 51/439 |

*Primary Examiner*—Frederick R. Schmidt
*Assistant Examiner*—Robert A. Rose
*Attorney, Agent, or Firm*—Pearne, Gordon, Sessions, McCoy, Granger & Tilberry

[57] ABSTRACT

An angular blasting nozzle having a replaceable section that substantially exclusively intercepts and turns abrasive flow from an inlet flow path to an obtuse outlet flow path. The nozzle is conveniently formed of a pair of mating, rectangular, prismatic sections which are well suited for fabrication from long-wearing materials such as tungsten carbide.

7 Claims, 3 Drawing Figures

SANDBLAST NOZZLE

BACKGROUND OF THE INVENTION

The invention relates to blasting nozzles and, in particular, to such nozzles having an obtuse angle between inlet and outlet passages.

PRIOR ART

Blasting nozzles for directing a stream of air and abrasive particles such as sand, metal grit, shot, aluminum oxide, or silicon carbide, are commonly used for cleaning or otherwise modifying the surface of an object. In many instances, a surface to be treated by blasting is within a cavity of a vessel, pipe, mold, or other area of limited accessibility. In applications where access is limited, an angular blasting nozzle is often employed so that a supply line can be directed into a confined area while the blast stream is directed angularly from the supply line so as to impinge on a surface parallel or oblique to the supply line.

A problem which commonly exists in the operation of an angular blasting nozzle is that the interior of the nozzle is worn away on that portion of the boundary of its internal passage which confines and redirects the abrasive stream. The momentum of abrasive particles in the flow resists the directional change imposed on the passage boundary area at the outside of a turn or bend in such passage. Eventually, the wall of the nozzle is worn away and the nozzle loses its effectiveness.

It is widely known, as shown for example in U.S. Pat. Nos. 2,428,276 to Griswold and 2,801,133 to Ridley, to form a blasting nozzle with extra material in the wall of the nozzle at the outside of a bend. It is also known to use abrasion-resistant material, such as tungsten carbide, boron carbide, alumina, or ceramic, as an insert for a blasting nozzle or to make the blasting nozzle itself.

SUMMARY OF THE INVENTION

The invention provides an angular blasting nozzle including a replaceable cap section having dimensions sufficient to provide substantially the entire surface area that is effective to redirect abrasive flow. This replaceable section has a configuration that avoids the necessity of an exterior casing and is especially suited for shaping by casting or molding techniques and subsequent grinding, making it particularly adapted to be made of long-wearing materials such as carbide or ceramics.

In the disclosed embodiment of a nozzle assembly, both the cap section and a cooperating nozzle base are prismatic or blocklike in form. The prismatic character of these elements permits them to be readily and economically clamped and shaped by grinding processes customarily used in the production of carbide parts. The nozzle base is provided with an elongated slot having a rectangular cross section complementary to the cross section of the cap section. The cap section is assembled in the slot of the base and the outlet passage of the nozzle is formed by opposed, semicylindrical cavities provided in the bottom of the slot and an inward face of the cap section. The bottom surface of the nozzle base slot and the inward face of the cap section form a parting line through the outlet passage. Leakage of abrasive across this parting line is avoided by the geometry of the base and cap section. Resistance to leakage is afforded by abutment of the cap section with the sidewalls of the slot and the resulting tortuous path such leakage would be required to take. The disclosed cap and base configuration thus makes it practical to assemble and use these members without gaskets or other separate sealing elements.

Wear is restricted primarily to the replaceable cap section of the nozzle, since it almost exclusively forces the change in direction of abrasive flow. Removal and replacement of the cap section are simple procedures accomplished with minimum effort and time. Where the nozzle cap and base sections are formed of the same material, the nozzle base has demonstrated a usable life in the order of 20 times that of the cap section. The cap section represents a relatively small fraction of the total material of the nozzle, so that considerable savings are realized in its replacement as compared to replacement of an entire nozzle.

DESCRIPTION OF THE PREFERRED EMBODIMENT

Figure 1:
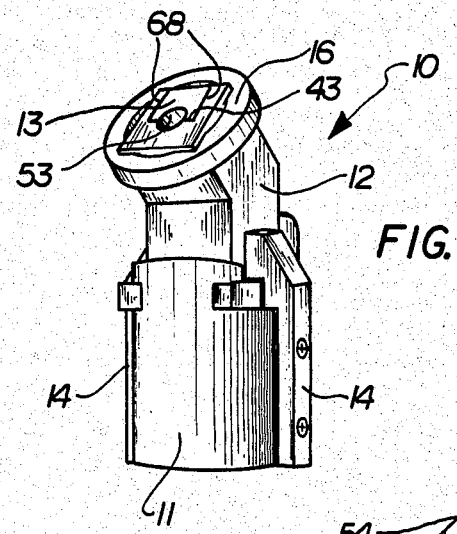
FIG. 1 is a perspective view of a nozzle assembly constructed in accordance with the invention.
Figure 2:
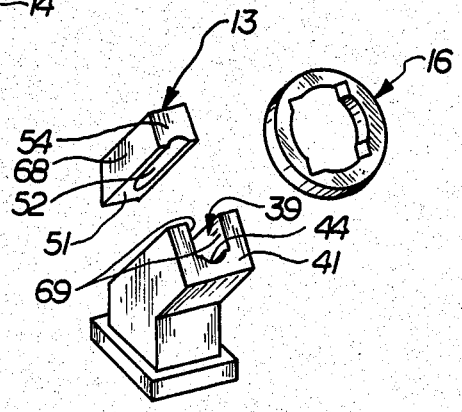
FIG. 2 is an exploded, perspective view of the nozzle assembly.
Figure 3:
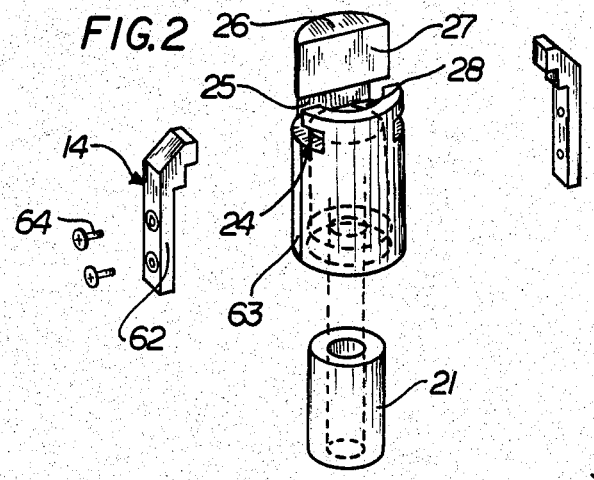
FIG. 3 is the cross-sectonal view of the nozzle assembly taken in a plane parallel to both the inlet and outlet flow passages.
Figure 3:
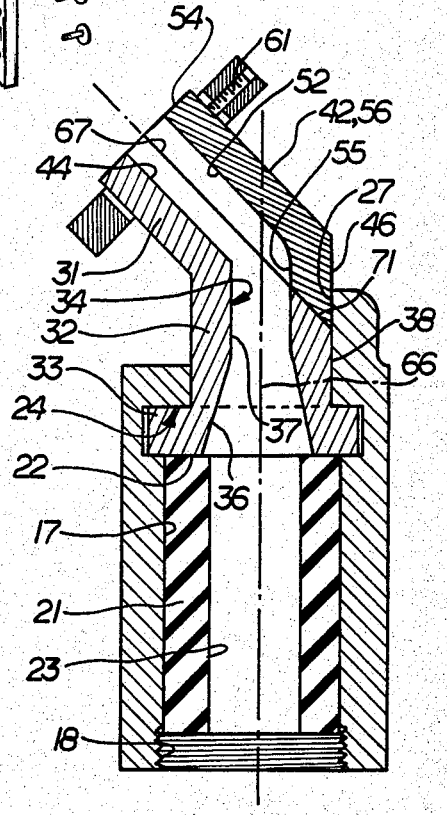

Referring now to the drawing, a nozzle assembly 10, constructed in accordance with the invention, principally comprises a carrier body 11, a nozzle base 12, and a nozzle cap section 13. The base 12 is removably retained on the carrier body 11 by side clamps 14. The nozzle cap 13 is removably retained on the nozzle base 12 by a holding ring 16.

The carrier body 11 is a generally cylindrical, tubular element, machined or otherwise formed from carbon steel. An interior longitudinal bore 17 of the body 11 is formed with female pipe threads 18 at its inlet end to thereby provide means for mounting the nozzle assembly 10 to a pipe or conduit and connecting it to a source of abrasive flow. The bore 17 is lined with a tubular rubber insert 21 which extends from the threads 18 to a face 22 of the nozzle base 12. The rubber insert 21 is dimensioned to be axially compressed between the pipe to which the carrier body 11 is coupled by the threads 18 and the nozzle base 12. A flow of the abrasive enters the carrier body 11 at the end of the bore 17 provided with the threads 18, and passes through a bore 23 of the rubber insert 21.

A T-slot 24 is machined or otherwise formed in the downstream end of the body 11 transversely to the bore 17. The stem portion of the T-slot is designated 25, and the cross portion of the T-slot is designated 28. The cross portion 28 of the T-shape or undercut is rectangular and has a width somewhat greater than the diameter of the bore 17. At one side of its downstream end, the carrier body 11 is formed with an axial extension 26. The extension 26 has a substantially flat nozzle alignment surface 27 extending from one side of the stem portion 25 of the T-slot 24 so that it lies in a plane parallel to the axis of the bore 17 and perpendicular to the plane of the cross portion 28 of the T-slot.

The nozzle base 12 is a unitary body, with its primary form geometrically described as two rectangular, prismatic elements 31, 32 joined in an oblique angle preferably corresponding to the angle of the nozzle, which, in the disclosed case, is 135 degrees. At its entrance end, the upstream prismatic element 31 has a rectangular flange 33 extending around its full periphery. The prismatic element 31 and associated flange 33 are proportioned to slide freely into the carrier body T-slot 24. The transverse dimensions of the rectangular flange 33 are greater than the diameter of the carrier body bore 17. Internally, the nozzle base 12 is formed with a flow passage 34 having at its upstream end a flow condensing throat 36. The throat 36 is shaped in the form of a simple cone that decreases in diameter in the direction of flow. The throat 36 merges with a cylindrical portion 37 of the flow passage 34. The throat 36 and cylindrical portion 37 are coaxial with each other and, when the base 12 is assembled on the carrier 11, are coaxial with the bore 17. In the assembled state, a rearward side 38 of the nozzle base 12 abuts the alignment surface 27.

The downstream, oblique, prismatic nozzle element 32 is formed with a channel or slot 39 of primarily rectangular cross section and extends from an outlet end 41 of the nozzle base 12 to the rear side 38. The channel 39 is thus open to an outer face 42 of the prismatic element 32. A base or bottom surface 43 of the channel or slot 39 is formed with an open-side, semicylindrical passage or channel 44 that intersects the cylindrical flow passage portion 37. The passage 44 extends from the outlet end 41 of the nozzle element 32 and terminates in communicaton with the flow passage 34.

The cap section 13 of the nozzle assembly 10 is described as a generally rectangular prism proportioned to be received in the rectangular channel 39 with a slip fit. An upstream or rearward end face 46 of the cap 13 lies in a plane oblique to its longitudinal axis. The cap section 13 is properly assembled in the rectangular channel 39 when this face 46 is abutted against the alignment surface 27.

An inner face 51 of the cap section 13 is formed with an open semicylindrical groove or channel 52 which aligns with the like groove 44 in the nozzle base element 32. These grooves 44 and 52 mutually form a cylindrical outlet passage 53. The groove 52 is open at an outlet end face 54 and extends longitudinally to a blind end surface 55 having a configuration that smoothly extends the nozzle base cylindrical passage portion 37 and then merges with the main length of the associated groove 52. This rearward groove end face 55 is spaced a sufficient distance from the cap end face 46 to provide a cap wall area having a thickness generally equal to the minimum wall thickness of remaining areas of the cap immediately surrounding the groove 52. The thickness of this wall area and the wall area between the groove 52 and an outer cap surface 56 are sufficiently generous to provide extra material stock to delay complete erosion of these wall areas. For example, as shown, the wall thickness of the cap 13 outward of the groove 52 is at least equal to the minimum wall thickness of the nozzle base surrounding the cylindrical bore portion 37. The outer face 56 of the cap section 13 is flush or coplanar with the outer face 42 of the nozzle base element 31. The holding or clamp ring 16 is formed of carbon steel or other suitable material, and has an aperture sized to slip over the oblique downstream nozzle element 32. With the clamp ring 16 properly positioned around the oblique nozzle element 32, a setscrew 61 bearing on the cap face 56 is tightened to releasably secure the cap 13 on the nozzle base 12.

The nozzle base 12 is releasably locked in assembled position in the carrier slot 24 by the pair of opposed side clamps 14. The clamps 14, ideally, are identically formed of carbon steel or other suitable material. Inner faces of leg portions 62 of the side clamps 14 seat on opposed flats 63 formed on the exterior of the carrier body 11. The clamps 14 are secured to the body 11 by screws 64 turned into threaded holes in the flats 63.

The nozzle base 12 and cap section 13 are preferably formed of material characterized by high resistance to abrasion. Examples of such material are alumina, silicon carbide, boron carbide, ceramic, and the like. Tungsten carbide is especially suitable. Desirably, the nozzle base 12 and nozzle cap 13 are formed of the same material, although this is not necessary. The cap section 13 lies in the outside of the bend or turn in the stream of abrasive material measured by the angle between the axis, designated 66, of the inlet passage 34 and the axis, designated 67, of the outlet passage 53. As a result, the cap section 13 experiences the greatest amount of wear, since it is the primary element which redirects the flow of abrasive material that impinges on it. Particles of abrasive exiting from the flow passage 34 impinge directly on the cap 13, glance off the cap 13, and eventually take up a path parallel to the outlet passage 53. It will be seen that the groove surface 52, 55 exclusively form the boundary surface of the turn of the flow path to the nozzle. In actual use, the nozzle base 12 can outlast the cap section 13 by a ratio of 20:1 where these elements are constructed of the same material. It is therefore beneficial for the cap section 13 to be as small as practical, and thereby constitute a minimum of material which must necessarily be replaced during extended periods of operation of the nozzle.

The cap 13 and base 12 abut on a plane of contact between the inner cap surface 51 and the channel base surface 43. This plane passes diametrically through the outlet passage 53 and a limited portion of the passage 34 formed by the cylindrical area 37. The planes of the cap sides 68 abut the sidewalls 69 of the rectangular base channel 39. It has been found that with the disclosed geometry of the perpendicular planes of contact between the cap 13 and base 12, with a sliding fit therebetween, sufficient resistance to leakage is afforded without the requirement of a gasket or like sealing means between respective surfaces of these elements. It is noted that leakage along the plane of contact at the rearward end of the cap 13 in the area designated 71 is likewise avoided without gaskets because this path is reversed from the main flow direction and is additionally blocked by abutment between the alignment surface 27 and adjacent surfaces of the cap 13 and base 12.

The prismatic configurations of the nozzle base 12 and cap 13 lend themselves to fabrication from tungsten carbide and like materials. Such materials are ordinarily cast and then finish-ground. The disclosed shape of these members 12, 13 simplifies molding of their preforms and grinding operations, particularly such operations necessary to clamp or hold these parts during grinding.

Although the preferred embodiment of this invention has been shown and described, it should be understood that various modifications and rearrangements of the parts may be resorted to without departing from the scope of the invention as disclosed and claimed herein.

What is claimed is:

1. An angular nozzle assembly for spraying abrasive material comprising a body having a closed boundary passage including an inlet for receiving material flow along a first axis, elements associated with the body forming a closed boundary outlet passage in communication with the inlet passage, the outlet passage having an outlet for expelling material flow along a second axis forming an angle of substantially less than 180° with said first axis so as to turn the material flow from the direction it is received at the inlet, one of said elements forming the outside of the boundary of the outlet passage, with reference to and including the turn, being formed of a highly abrasion-resistant material and being separable from remaining portions of the nozzle for replacement when worn out, said body having a slot generally parallel to said outlet passage, said outside boundry forming element being disposed in said slot, said outside boundary forming element extending lengthwise from an area intercepting flow along the first axis substantially to the outlet, a carrier for supporting said body and the outside boundary forming element and for coupling the inlet passage with a conduit supplying abrasive flow in the direction of the first axis, the inlet and outlet passages being serially arranged and forming the exclusive path for all material flow through the nozzle, means releasably securing said outside boundary forming element on said body and a surface on the carrier cooperating with the securing means to maintain said outside boundary forming element in position on said body.

2. A nozzle assembly as set forth in claim 1, wherein said releasable securing means clamps said outside boundary forming element on said body.

3. A nozzle assembly as set forth in claim 1, wherein said outlet passage is round in cross section, said outside boundary forming element forming a semi-circular portion of said round cross section.

4. A nozzle assembly as set forth in claim 1, wherein said releasable securing means is arranged to maintain said outside boundary forming element in said slot.

5. An angular blasting nozzle comprising separate base and cap elements, the base cap elements being arranged to be assembled together to form a singular flow passage for all material flow including serially interconnected inlet and outlet portions, the inlet portion defining, adjacent one end of the nozzle, a first flow direction, the outlet portion defining, adjacent the opposite end of the nozzle, a second flow direction, the flow passage having a bend between the inlet and the outlet portions such that the first and second flow directions of the inlet and outlet portions form an oblique angle, the cap element having interior surfaces which substantially exclusively provide a boundary of the flow passage on the outside of the bend, the cap and base elements having interfitting surfaces disposed in a plurality of planes that are effective in sealing against leakage along substantially all paths lateral to said second flow direction, a carrier body for supporting said base and cap elements and for coupling said inlet portion with a conduit supplying abrasive flow in the first flow direction, means to releasably secure the cap and base elements together and a surface on the carrier body cooperating with the securing means to maintain said cap element in position on said base element.

6. A blasting nozzle as set forth in claim 5, wherein said cap element, in assembly with said base element, abuts said base element directly across a plurality of planes, said planes being arranged to provide sufficient resistance to leakage to avoid the necessity of separate sealing elements at these planes.

7. An angular blasting nozzle comprising a base element and a cap element, the base element being formed of a pair of rectangular prismatic sections, said sections being integrally joined with one another and forming with their longitudinal axes an obtuse angle, an upstream one of said sections having a closed boundary inlet passage, a downstream one of said sections having an axially extending open-faced slot of predetermined cross section and including a bottom surface, the bottom surface including an open-faced channel communicating between the inlet passage of the upstream section and a distal end face of the downstream section, the cap element having a cross section complementary to said open-faced slot thereby permitting it to be received in such slot, the cap element having a length somewhat greater than said channel whereby it envelops a downstream end of said inlet passage in said upstream section, said cap element, when assembled in said slot, closing off the open face of said channel, thereby cooperating with said channel to form an outlet passage at an angle to said inlet passage generally equal to said first-mentioned obtuse angle, the relationship of said cap section to said upstream inlet passage being such that it intercepts and redirects substantially exclusively the entire flow of abrasive material expelled from said inlet passage into said outlet passage, a carrier body for supporting the base element and the cap element and for coupling the inlet passage with a conduit supplying abrasive flow in the direction of flow in the inlet passage, means for releasably securing said cap section in said slot, a surface on the carrier body cooperating with the securing means to maintain the cap section in position on the base element.

* * * * *